US005529542A

United States Patent [19]

Mansfield

[11] Patent Number: 5,529,542

[45] Date of Patent: Jun. 25, 1996

[54] REDUCING VELOCITY OF A ROLLING OBJECT

[75] Inventor: Clifford Mansfield, Mainridge, Australia

[73] Assignee: Cliffman Investments Pty. Ltd., Australia

[21] Appl. No.: 184,851

[22] Filed: Jan. 18, 1994

Related U.S. Application Data

[63] Continuation of Ser. No. 842,117, filed as PCT/AN90/00447, Sep. 25, 1990, published as WO91/04771, Apr. 18, 1991, abandoned.

[30] Foreign Application Priority Data

Sep. 29, 1989 [AU] Australia ..... PJ6609

[51] Int. Cl.[6] ..... A63B 67/18

[52] U.S. Cl. ..... 473/112; 273/411

[58] Field of Search ..... 273/177 A, 126 A, 273/26 A, 41, 127 R, 54 R, 37, 39; 473/112

[56] References Cited

U.S. PATENT DOCUMENTS

| | | | |
|---|---|---|---|
| 954,299 | 4/1910 | Johnson | 273/177 A |
| 1,529,749 | 3/1925 | Morrison | 273/177 A |
| 2,188,740 | 1/1940 | Rietschel . | |
| 2,467,549 | 4/1949 | Ely et al. | 273/177 A |
| 2,525,881 | 10/1950 | Felter | 273/127 R |
| 2,742,292 | 4/1956 | Davis | 273/177 A |
| 3,001,795 | 9/1961 | Johnson, Jr. | 273/26 A |
| 3,105,685 | 10/1963 | Jahn | 273/41 |
| 3,171,657 | 3/1965 | Strang | 273/177 B |
| 3,313,544 | 4/1967 | Davis | 273/177 A |
| 3,785,656 | 1/1974 | Gybowski | 273/177 A |
| 3,873,097 | 3/1975 | Willis | 273/177 A |
| 4,127,267 | 11/1978 | Bay | 273/26 A |
| 4,220,332 | 9/1980 | Mendez | 273/41 |
| 4,275,883 | 6/1981 | Grimaldi | 273/26 A |
| 4,691,922 | 9/1987 | Peel | 273/177 B |
| 4,809,988 | 3/1989 | Hunter | 273/177 A |
| 5,071,127 | 12/1991 | Bromley | 273/126 A |
| 5,181,721 | 1/1993 | Halliburton | 273/177 A |

FOREIGN PATENT DOCUMENTS

| | | | |
|---|---|---|---|
| 9967/66 | 2/1969 | Australia . | |
| 480071 | 7/1929 | Germany . | |
| 660057 | 10/1964 | Italy | 273/177 A |
| 2150843 | 7/1985 | United Kingdom . | |
| 2194893 | 3/1988 | United Kingdom | 273/177 A |
| 2211101 | 6/1989 | United Kingdom . | |
| 2257637 | 1/1993 | United Kingdom | 273/177 A |

*Primary Examiner*—Theatrice Brown
*Attorney, Agent, or Firm*—Larson and Taylor

[57] ABSTRACT

A device (13) is provided for reducing the velocity of a passing rolling object (5) by absorbing kinetic energy therefrom. The object (5) can be a lawn bowl. The device (13) has co-operating means ( 18) which engage with the bowl to absorb kinetic energy without substantially altering the trajectory of the bowl. When used with a bowl it can reduce the length of a bowling rink while permitting a bowler to deliver the bowl as if playing on a full length rink. A bowling rink and a game of bowls using such device (13) are also disclosed.

5 Claims, 7 Drawing Sheets

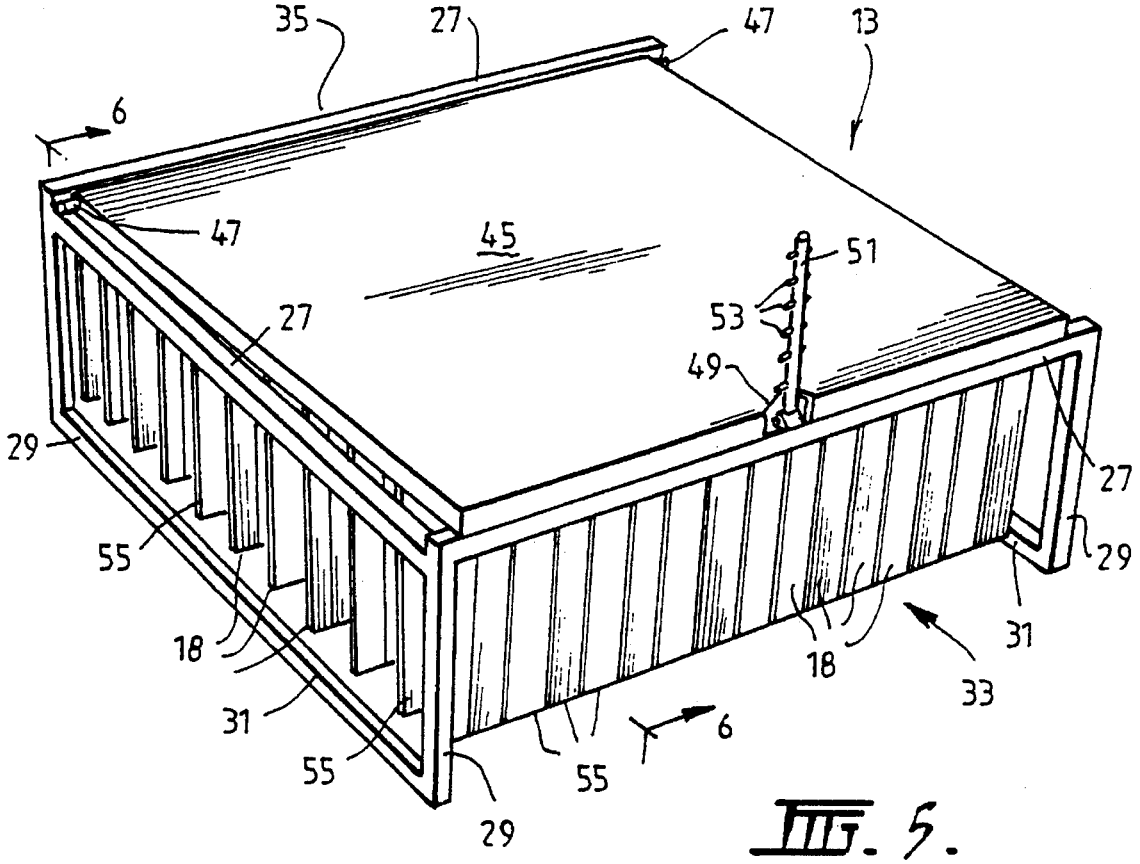
FIG. 5.
FIG. 6.
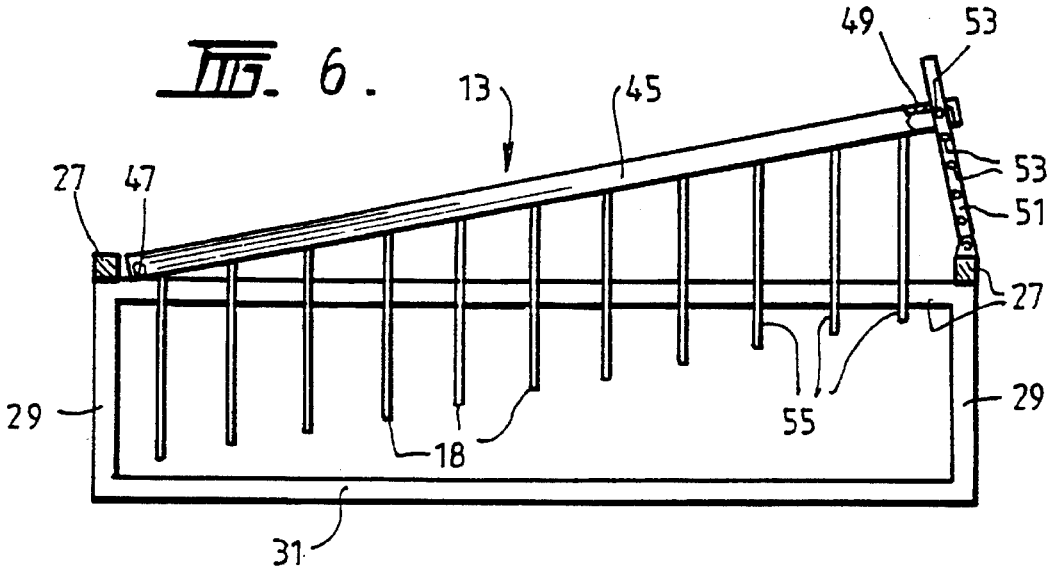

REDUCING VELOCITY OF A ROLLING OBJECT

This application is a continuation of application Ser. No. 07/842,117, filed as PCT/AU90/00447,Sep. 25, 1990, published as WO91/04771, Apr. 18, 1991, now abandoned.

BACKGROUND OF THE INVENTION

This invention relates to reducing the velocity of a rolling object and relates particularly, but not exclusively, to reducing the velocity of a bowling bowl along an intended trajectory without substantially altering the trajectory whereby a game of bowls can be played on a shorter length rink with substantially the same delivery as that provided on a normal length link.

DESCRIPTION OF THE PRIOR ART

Lawn bowls is a very popular sport internationally. Usually, the game is played on an outdoor lawn green which is expensive to set up and maintain. In addition, inclement weather reduces the number of days upon which the game can be played.

Indoor bowling greens have been established but these have been expensive and moreover, the cost of playing on such indoor greens is high owing to the overhead costs of such establishments and the lengthy duration of each game.

With outdoor greens, it is very difficult to obtain access to a rink to practice bowling as the green is usually fully occupied throughout daylight hours. Bowling in the evening is not usually considered desirable owing to the dew factor on the green. Thus, it has been exceedingly difficult for bowlers to practice delivery on outdoor greens, and because of the cost problems associated with hiring an indoor green, bowlers do not obtain the required or desired practice.

OBJECT AND STATEMENT OF INVENTION

The present invention has been devised with the principle object of providing a device for reducing the velocity of a rolling object. In the case of lawn bowls, it enables shorter length rinks to be provided which, in turn, means that the width of a rink can be reduced which, in turn, means that a greater number of rinks can be provided in a given area than with a normal bowling rink. Thus, the cost of playing bowls can be significantly reduced which, in turn, means players will have a greater opportunity of being able to play or to practice. In addition, because the length of each rink is shorter than in a conventional length rink, the time associated with playing a game can be significantly reduced owing to the lesser distance travelled by the bowls and this will enhance the game of bowls.

Therefore, in accordance with a first broad aspect of the present invention there may be provided a device for reducing the velocity of a passing rolling object, said device comprising frame means for supporting velocity reducing means relative to an intended trajectory of said object, said velocity reducing means comprising co-operating means which will co-operate with the object to provide kinetic energy absorption therefrom so the velocity of said object will be reduced without substantially altering the trajectory of said object.

Most preferably said co-operating means is adjustable for permitting the amount of kinetic energy absorption to be changed to, in turn, permit the amount of velocity reduction to be changed.

Most preferably said co-operating means comprises a surface which contacts a surface of said object during passage of said object therepast.

It is particularly preferred in one embodiment that said co-operating means comprise the undersurface of a suspended mat which has a section which lies on the surface over which said object rolls so that during the passage of said object, it will lift said mat to thereby absorb some of the kinetic energy of said object. It is also preferred following passage of said object that said mat be provided to move back to said surface over which said object rolls, so that upon the passage of a further rolling object it will be ready to absorb substantially the same amount of kinetic energy therefrom as for the preceding rolling object.

It is also particularly preferred that said co-operating means act bi-directionally so that it will reduce the velocity of said object independent of its direction of movement along the intended trajectory.

It is particularly preferred in a further embodiment that said co-operating means comprise a plurality of depending members which are suspended from a position above the height of the object and depend downwardly to be engaged by the object whereby kinetic energy will be absorbed therefrom.

Most preferably the device is sized so it can act to reduce the velocity of a bowling bowl used in the game of lawn bowls so the game can be played on a shorter length rink than normal without substantially altering the player's bowling delivery relative to playing on the normal length rink.

Most preferably the device is fitted midway of a bowling rink so it will provide velocity reduction at substantially the same position along the intended trajectory regardless of the direction of approach of the bowls.

According to a further aspect of the present invention there may be provided a bowling rink of shorter length than a normal length bowling rink, said bowling rink comprising a surface upon which bowls can be played and a device for reducing the velocity of a passing rolling bowling ball, said device comprising frame means for supporting velocity reducing means relative to said surface and an intended trajectory of said bowls, said velocity reducing means comprising co-operating means which will co-operate with each bowl travelling along the intended trajectory and on said surface to provide kinetic energy absorption therefrom so the velocity of each bowl will be reduced without substantially altering the trajectory thereof, whereby a game of bowls can be played without substantially altering the player's bowling delivery relative to playing on a normal length bowling rink.

Most preferably said bowling rink forms part of a bowling green containing many such bowling rinks.

Most preferably said device is removable from said rink whereby to enable the surface to be used for other purposes when bowls is not to be played.

According to a further aspect of the present invention there may be provided a game of bowls comprising:

(a) providing a device for reducing the velocity of the bowls at a position along an intended trajectory of the bowls, intermediate the point of intended delivery and the intended position of resting of the bowls;

(b) delivering a bowl along said trajectory;

(c) allowing said device to co-operate with said bowl to absorb kinetic energy therefrom without substantially altering the trajectory of said bowl;

whereby the velocity of said bowl can be reduced to permit said bowl to come to rest in a shorter distance than the delivery would normally achieve.

Most preferably said method includes the step of contacting a surface of the bowl by co-operating means associated with said device so the bowl will roll over a substantially constant surface along its intended trajectory.

It is also preferred that the said method involve providing different kinetic energy absorption levels so that the game being played will simulate a game played on a conventional sized lawn bowling rink allowing for desired length of ends to be varied as required by the players without substantially altering the delivery required relative for playing to an end of conventional sized rink.

BRIEF DESCRIPTION OF DRAWINGS

In order that the invention can be more clearly ascertained, examples of preferred embodiments for use in playing bowls will now be described with reference to the accompanying drawings, wherein:

FIG. 5 is a front perspective view of another preferred device;

FIG. 6 is a side sectional view taken along section line 6—6 of FIG. 5;

DETAILED DESCRIPTION OF PREFERRED EMBODIMENTS

Figure 1:
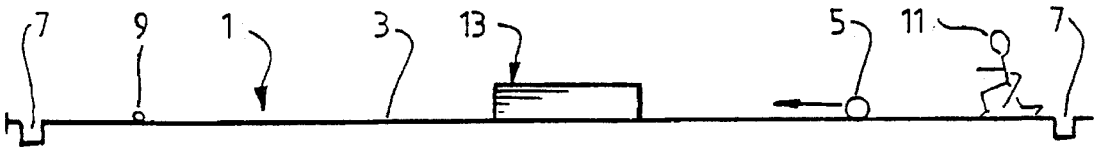
FIG. 1 is a diagrammatic side view of a rink incorporating a preferred device.

Referring now to FIG. 1, there is shown a bowling green 1 having a surface 3 over which a bowling ball 5 can roll. The surface 3 can be of any desired material such as grass, synthetic grass, carpet or other surface which is substantially uniform in texture along the length of the rink 1. The rink 1 may have channels 7 at each end to catch bowls which proceed further than intended past a jack 9. The channels 7 are provided at each end of the rink 1 so that the bowlers 11 can deliver the bowls 5 from selected ends of the rink 1, i.e. in one direction along an intended trajectory and then in the opposite direction along the intended trajectory.

Figure 2:
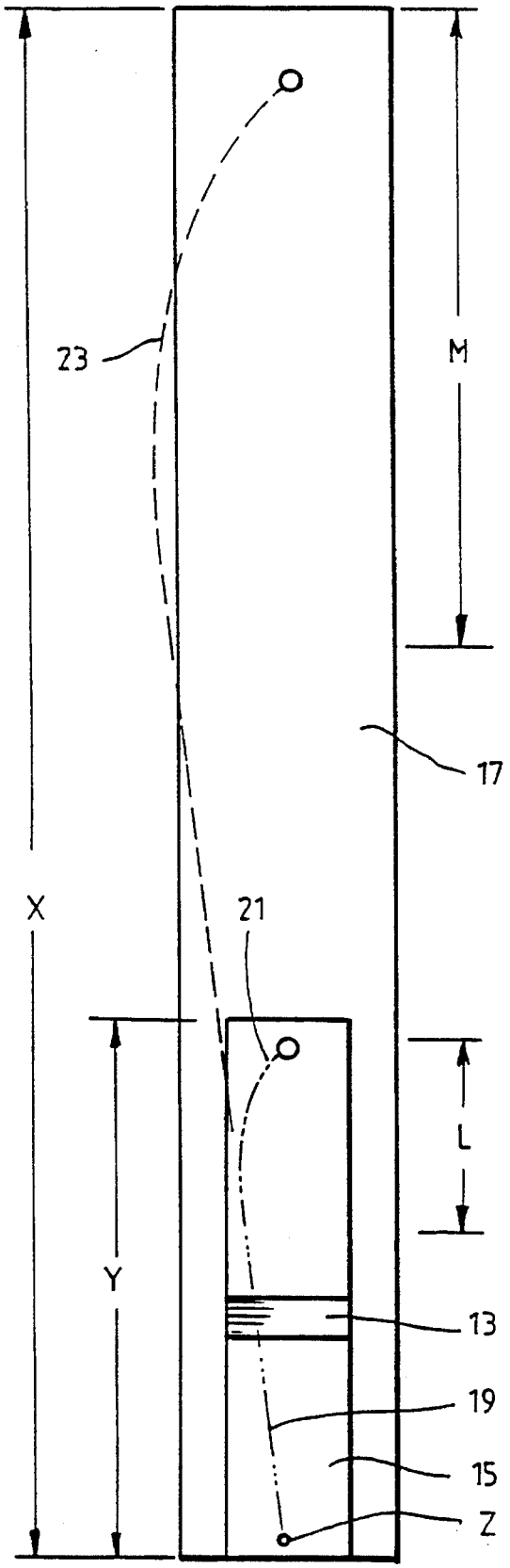
FIG. 2 is a plan view of a conventional rink superimposed with a rink of shorter length which can be utilised by embodying examples of the present invention.

The device 13 is shown in diagrammatical form in FIG. 2 placed on a shorter length rink 15 than a full length rink 17. Here, the shorter length rink 15 is about one third the length of the full rink 17. Typically the length of a full rink 17 is shown by length X which is in the range 37 meters to 40 meters. The shorter length rink 15 is shown having a length Y which can conveniently be 10 meters to 18 meters although this length range is not to be taken literally. It represents a convenient length as will be appreciated hereinafter. It is also noted that the rink 15 is somewhat narrower than rink 17. A typical example of width of rink 17 is in the range 5.5 meters to 5.8 meters. A typical width of rink 15 is in the range 2.5 meters to 4 meters. Point Z in FIG. 2 represents the position of delivery of a bowl on both the conventional rink 17 and the shorter rink 15. Here the trajectory is shown as being along trajectory line 19. In the case of the shorter rink 15 the bowl passes through the device 13 and kinetic energy is absorbed therefrom without substantially altering the trajectory such that the speed of the bowling ball is reduced considerably. The bowl passes the device 13 and because of its reduced velocity is subject to a bias trajectory shown generally by numeral 21 during the final part of its travel. The bias length is shown by length L. In the case of a conventional rink 17 the bowling ball is delivered along trajectory 19 but the bowl does not pass through the device 13. The bowl may pass outside the width of the rink 17 as shown by the dotted line trajectory. The bowl will then have a bias trajectory 23 during its final path before coming to rest. This has been indicated by length M.

Thus, it can be seen that the length of rink 15 is considerably shorter than the length of rink 17 and that for a bowl delivered along trajectory 19 with the same velocity regardless of whether it is on rink 15 or rink 17, it will eventually arrive at a final resting position and be subject to bias trajectories 21 or 23 at the end of its path of travel. In the case of rink 15 the device 13 has absorbed some of the kinetic energy of the bowl without substantially altering the trajectory of the bowl as it passes device 13. In the case of the shorter rink 15, because the bowl has a reduced velocity on passing device 13 it will be subject to a bias trajectory 21 sooner than in the case if it were travelling on the conventional rink 17. Thus, the bowl comes to rest in a shorter overall length that on a conventional rink. In addition the time taken to travel the length to rest on rink 15 is less than that on rink 17. Thus it can be appreciated that with the use of the device 13 the actual rolling time of the bowl will be substantially less than that on the conventional rink 17 and hence this will contribute to speeding up game play. In addition, because the shorter length rink 15 has the jack (not shown in FIG. 2) at a position closer to the bowler than in the conventional rink 17 the bowler is able to more easily sight the position of the jack relative to any other bowls which may be in the vicinity of the jack. Thus, because a shorter length rink 15 is used players are able to observe the intended final resting position of their bowl easier than on a conventional rink 17 and thus there can be increased competitiveness between players.

It is noted that in both the cases of the shorter length rink and the conventional rink 17, the bowl is delivered along the same trajectory 19 and thus, use of the device 13 provides satisfaction to a player because the game feels the same as the game on the conventional rink 17 at least so far as delivery of the bowl is concerned.

Figure 3:
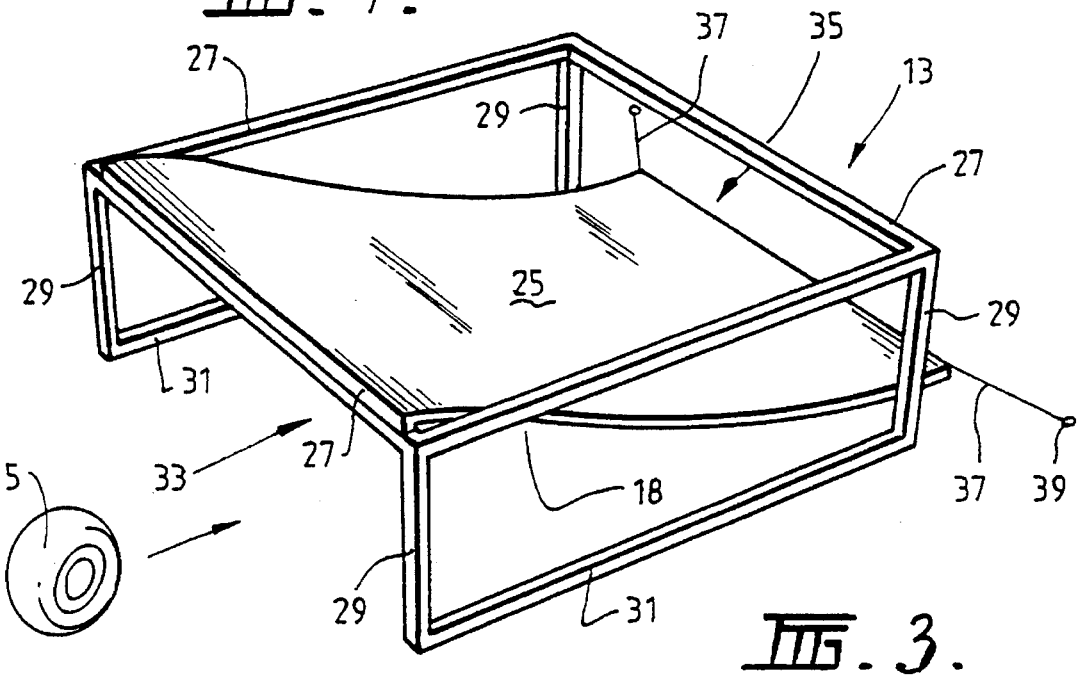
FIG. 3 is a top perspective view of one example of a preferred device.

Referring now to FIG. 3 there is shown one example of a device 13. The device 13 includes velocity reducing means 25 in the form of a mat which has co-operating means 18—the undersurface of the mat—for co-operating with the bowl to provide kinetic energy absorption therefrom so the velocity of the bowl will be reduced without substantially altering the trajectory of the bowl. Thus, as the bowl 5 rolls over the surface 3 it will enter the device 13 and have its upper surface engaged by the co-operating means 18. This will, in turn, lift the mat and reduce the velocity of the bowl as it passes therepast. The intended trajectory of the bowl will remain substantially unchanged. Whilst the bowl 5 is delivered with a normal delivery for a normal length rink 1 it will now stop in a shorter distance.

In the embodiment shown in FIG. 3 the co-operating means 18 forms part of a mat which comprises velocity reducing means 15. Other forms of co-operating means may be provided. For example, the co-operating means may comprise air blast means which will co-operate with the rolling bowl 5 to provide kinetic energy absorption therefrom. In this connection the air blast means may be directed to provide an air blast in the opposite direction to the direction of travel of the bowl 5. The air blast will be over a sufficient cross sectional area that it will be uniform and will not substantially alter the trajectory of the bowl 5 as it passes device 13. The co-operating means may comprise any convenient device which will allow for energy absorption which will, in turn, reduce the speed of the bowl 5 without substantially altering its trajectory. As a further example, the co-operating means may comprise a magnetic field means which will provide a magnetic field at device 13. Thus, when the bowl 5 passes, magnetic material which would be embedded within the bowl material composition itself or be provided as a core or as other circuit paths within the bowl 5 will re-act therewith so that there will be absorption of kinetic energy of the bowl 5 by the opposing magnetic fields which would be created in the bowl as a result of moving through the magnetic field at device 13. Thus, a magnetic field would be generated in bowl 5 as a result of the induced current flowing in the circuit paths therein and this field would, in turn, oppose the field created by device 13, thereby absorbing kinetic energy from the bowl 5.

Referring to FIG. 3 again, there is shown a top perspective view of the device 13. Here it can be seen that the device 13 comprises a frame 27 produced from suitable material such as steel. Typically, it can be rectangular tubular steel. The frame 27 is supported on upstanding legs 29 which are, in turn, connected to longitudinally extending rails 31. The rails 31 extend generally parallel with the intended trajectory of the bowl 5. The rails 31 effectively distribute the weight of the device 13 over the surface 3 so that indentations in the surface 3 will be unlikely to occur as a result of the device 13 resting thereon. Thus, the device 13 has an inverted U-shaped front opening 33 and a corresponding inverted U-shaped rear opening 35. The height of the legs 29 is greater than the diameter of the largest anticipated bowl 5 so that a bowl 5 can pass into the device 13 by passing through the front opening 33 and out through the rear opening 35.

The frame 27 supports the velocity reducing means 25 in the form of a mat. The undersurface of the mat provides the co-operating means 18 which will engage with the uppermost surface of the bowl 5 to absorb kinetic energy therefrom as the bowl passes the device 13. As shown, the mat is attached to the front of the frame 27 as by screwing it thereto with suitable screws so that it will hang downwardly from the frame 27 and over a portion of the surface 3. Thus, as the bowl 5 passes through the device 13 it will first contact the co-operating means 18 and lift the mat slightly as it passes therethrough. The mat will form a tunnel during the passage of the bowl 5 which will assist in maintaining the bowl 5 travelling along its intended trajectory without substantially altering the intended trajectory when the bowl 5 leaves the device 13.

The co-operating means 18 has surface texture which will enhance kinetic energy absorption. In this embodiment it has been found that carpet-like surfaces provide good kinetic energy absorption. The mass of the mat should be sufficient to not readily deflect from the surface of the bowl 5 when the bowl 5 first engages with the mat. Typically, the velocity reducing means 25 has sufficient inherent resiliency so that following the passage of the bowl 5 it will return to a flatten condition on surface 3. Thus, the device 13 will then be ready to accept the subsequent bowl 5 and absorb substantially the same kinetic energy as for a previous bowl 5.

In order to assist the mat returning to the flattened condition on the surface 3, flattening inducing means 37 are provided. The flattening inducing means 37 is shown as elastic members which are pegged into the surface 3 by pegs 39 so that they will stretch the end of the mat flat. Other forms of flattening inducing means 33 may be employed. One example may conveniently comprise a bar or other member which will engage with the velocity reducing means 25 following passage of a bowl 5 to cause it lie flat on the surface 3. In other example it may comprise a tension bow member attached across the rear end of the mat to cause it to be tensioned to assume a flattened condition following passage of the bowl 5.

When the direction of bowling is to be reversed, the device 13 can be lifted and rotated 180° so that the U-shaped opening 25 will be directed towards the bowler 11. The pegs 39 can then be re-positioned.

Figure 4:
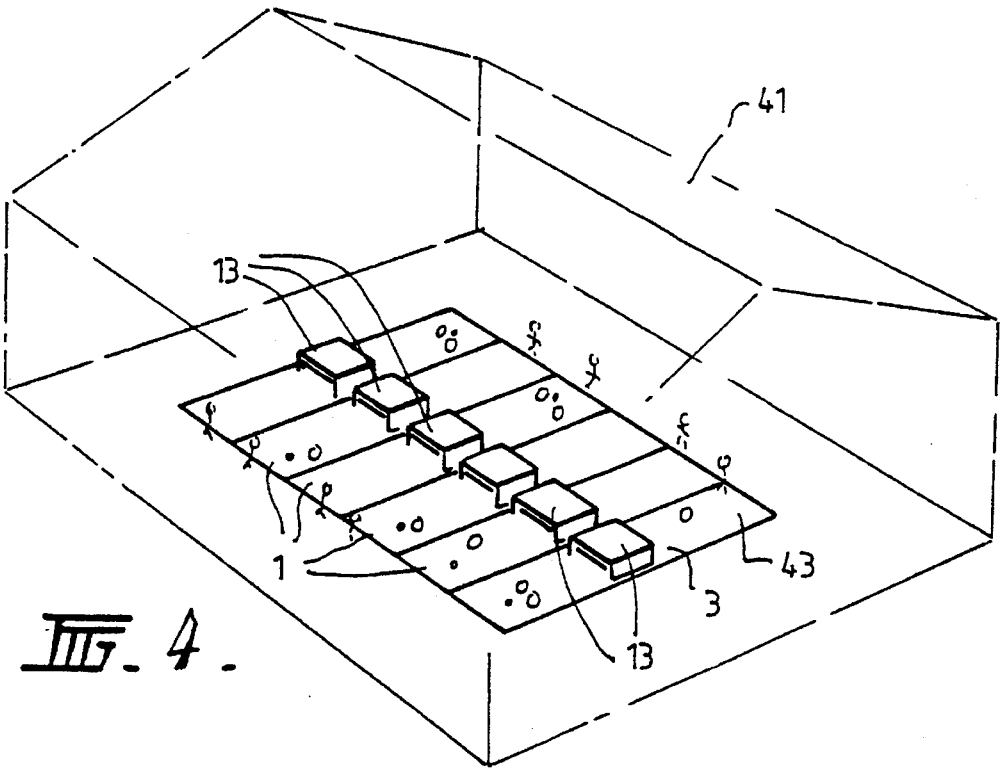
FIG. 4 is a diagrammatic perspective view of an indoor bowling green incorporating devices in accordance with the present invention.

Referring now to FIG. 4 there is shown a diagrammatic perspective view of an indoor bowling green within a building 41. Here a bowling green 43 is provided with a surface 3 which may comprise carpet or synthetic grass or other suitable material. The green 43 is divided into a number of rinks 1. The length of the rinks 1 is substantially shorter than a normal length bowling green rink. Because the rinks are shorter the widths can also be shorter as observed from FIG. 2. Situated intermediate the ends of each rink 1 are respective devices 13. The arrangement is such that bowlers can play and/or practice bowls in a shorter length rink than a normal length lawn bowls rink and yet deliver the bowl with the same delivery or substantially the same delivery for the normal length lawn bowls rink. Thus, the feel of bowling will be substantially the same as on a conventional lawn bowls rink but the distance of travel of the bowl 5 will be reduced by the device 13. The devices 13 are removable from the green 43 so the area within the building 41 can be used for other purposes. Thus, the use of the device 13 enables an economic bowling green 43 to be provided where otherwise the costs would be substantially prohibitive and would discourage bowlers to play and/or practice. Thus, in the case of the green 43 being provided within a building 51 the green 43 is not subjected to the weather and/or other climatic conditions for a conventional green. In addition, the game of bowls can be played during the day and at night provided there is sufficient lighting within the building 41.

The device 13 can be fitted to an outdoor bowling green and rink if required with the advantage that substantially more rinks 1 can be provided in a given bowling green 43 than for normal lawn bowls.

It should be noted that with use of the device 13 it is unlikely that a bowler will bowl into adjacent rinks 1 as the device 13 will contain the game on each rink widthwise.

Referring now to FIGS. 5 and 6 there is shown another example of device 13. Here the device 13 is particularly suited for use in home environments and the device 13 is made of a size and a weight which enables it to be moved easily. Here the device 13 is similar in nature to the device shown in FIG. 3. It has a frame 27 with legs 29 connected with rails 31. Thus the device 13 has a front opening 33 and a rear opening 35. The device 13 is provided with a hinged lid 45 which may be fabricated from sheet steel or other suitable material. The lid 45 extends over the surface area embraced by the frame 27. Hinge pins 47 extend laterally from one end of the lid 45. The hinge pins 47 may be secured in sleeves (not shown) welded or otherwise fastened to the frame 27 at one end. Alternatively, the pins 47 may simply rest on the upper surface of part of the frame 27. This version has been shown in FIGS. 5 and 6. The opposite end of the lid 45 is provided with a V-shaped cut-out 49. A pivoted rod 51 is pivotally mounted to the frame 27 to be in alignment with the cut-out 49. The rod 51 is provided with a series of spaced apart pairs of arms 53. The V-shaped cut-out 49 has a width across the V which is marginally greater than the width of the pair of arms 53. The arrangement is such that the lid 45 can rest on the frame 27, as shown in FIG. 5, or be elevated to various inclined positions as shown in FIG. 6 as determined by the vertical spacing apart of the pairs of arms 53. Thus, the lid 45 can be pivoted about pivots 47 so that one end is raised as shown in FIG. 6 and located and held in that position by relevant pairs of arms 53 passing through the V-shaped cut-out 49 and the arms 53 then engaging with the undersurface of the lid 45 in the region of the cut-out 49. Thus, the lid 45 can be retained in a desired pivoted position as determined by the vertical spacing apart of the pairs of arms 53.

The lid 45 carries a series of co-operating means 18 which comprise depending members 55 which are produced from a sheet of suitable materials such as rubber, plastics, vinyl or compounded materials which exhibit a flexible and resilient character. Thus, the depending members 55 are cut from the sheet material with slits therebetween. The slitting is not completely through the sheet material so the sheet material can provide a strip of depending members 55 which are fastened to the undersurface of the lid 45 in any suitable manner as by screwing thereto. Thus, there are a series of rows of depending members 55 across the intended trajectory of the bowl 5. The slitting is provided with a substantial width as for example 5 millimeters. This allows the depending members 55 to hang freely and not interfere with each other as a bowl 5 passes through the device 13. Thus deflexion of one depending member 55 by the bowl 5 is unlikely to be interrupted by contacting an adjacent depending member 55.

Each successive row of depending members 55 is arranged so that the depending members 55 are displaced laterally across the trajectory of the bowl 5 by half the width of a depending member. Thus, a bowl 5 entering the device 13 will engage initially with the first row of depending members 55 and then the next and so on, Because each row of depending members 55 is displaced laterally across the trajectory of the bowl 5 by half the width of a depending member 55, there will be no tendency for the bowl 5 to alter its trajectory slightly to follow a row of slits between adjacent depending members 55 as would be the case if the slits in each row were in alignment.

The provision of the pivoted rod 51 to raise and lower the lid 45 enables a control over the co-operating means 18 so that by raising the lid 45 there will be less of the surfaces of the co-operating means 18 to engage with the bowl 5 than if the lid 45 is in its lowermost position. Thus, raising the lid 45 will permit for less kinetic energy absorption from the bowl 5 than if the lid 45 is in its lowermost position. Thus, a bowler can control to some degree the intended length of bowling so that the bowler can simulate different lengths of bowling rinks on a conventional rink. Each of the pairs of arms 53 can be suitably marked to indicate the simulation—a 22 meter conventional rink, a 30 meter conventional rink, or a 38 meter conventional rink or any other lengths.

Referring now to FIGS. 7 through 12 there is shown a further example of device 13 which is similar in nature to the device shown in FIGS. 5 and 6. Here the device 13 is provided with a pair of side frames 59 which are produced from a suitable material such as steel. Each of the base portions 61 carries legs 63 which support an upper frame member 65. Each side frame 59 is identical. A lid 67 is carried by the side frames 59. The lid 67 is fabricated from any suitable material such as sheet steel as in the embodiment of FIGS. 5 and 6. The lid 67 carries depending members 55 in the same manner as that shown in the embodiment of FIGS. 5 and 6. Thus, this embodiment is substantially similar to that shown in FIGS. 5 and 6.

The lid 67 is supported on the upper frame members 65 by hinge pins 47 which pass through suitable holes in upstanding threaded posts 69 which are attached to the upper frame members 65. The threaded posts 65 carry nuts 71 which will permit for height adjustment of the threaded post 69 to, in turn, raise the position of pivoting of lids 67 relative to the surface 3. Thus, the height of lid 67 can be raised or lowered by the threaded post 69. The purpose of this will be explained in due course. The opposite end of the lid 67 carries a pair of cams 73 which are interconnected by an axle 75 so that both cams—being identical—are in angular alignment. Each of the cams 73 is arranged to align directly parallel with the upper frame members 65 and to engage on cam bearings 77 carried by brackets 79 fastened to the sides of the upper frame members 65. The axle 76 is, in turn, held to the lid 67 in journals 81 fastened to the upper surface of the lid 67. Thus, the journals 81 support the axle 75 so that it can be rotated about its longitudinal axis. A hand wheel 83 is provided at one end of the axle 75 to permit manual rotation of axle 75 to, in turn, cause the cams 73 to angularly rotate. Such rotation of the cams 73 will, in turn, cause the end of the lid 67 to which the cams 73 are attached to be raised and/or lowered depending on the angular position of the cams 73. A pair of fingers 85 are attached to the lid 67 so that one finger 85 is on one side of the lid 67 and the other finger 85 is in the opposite side of the lid 67. In this way the fingers 85 depend downwardly to a position below the upper frame members 65 and act as guides to maintain the lid 67 oriented squarely relative to the upper frame members 65. In other words, this enables the side frames 59 to be held in generally parallel spaced apart relationship at each side of the lid 67.

Figure 10:
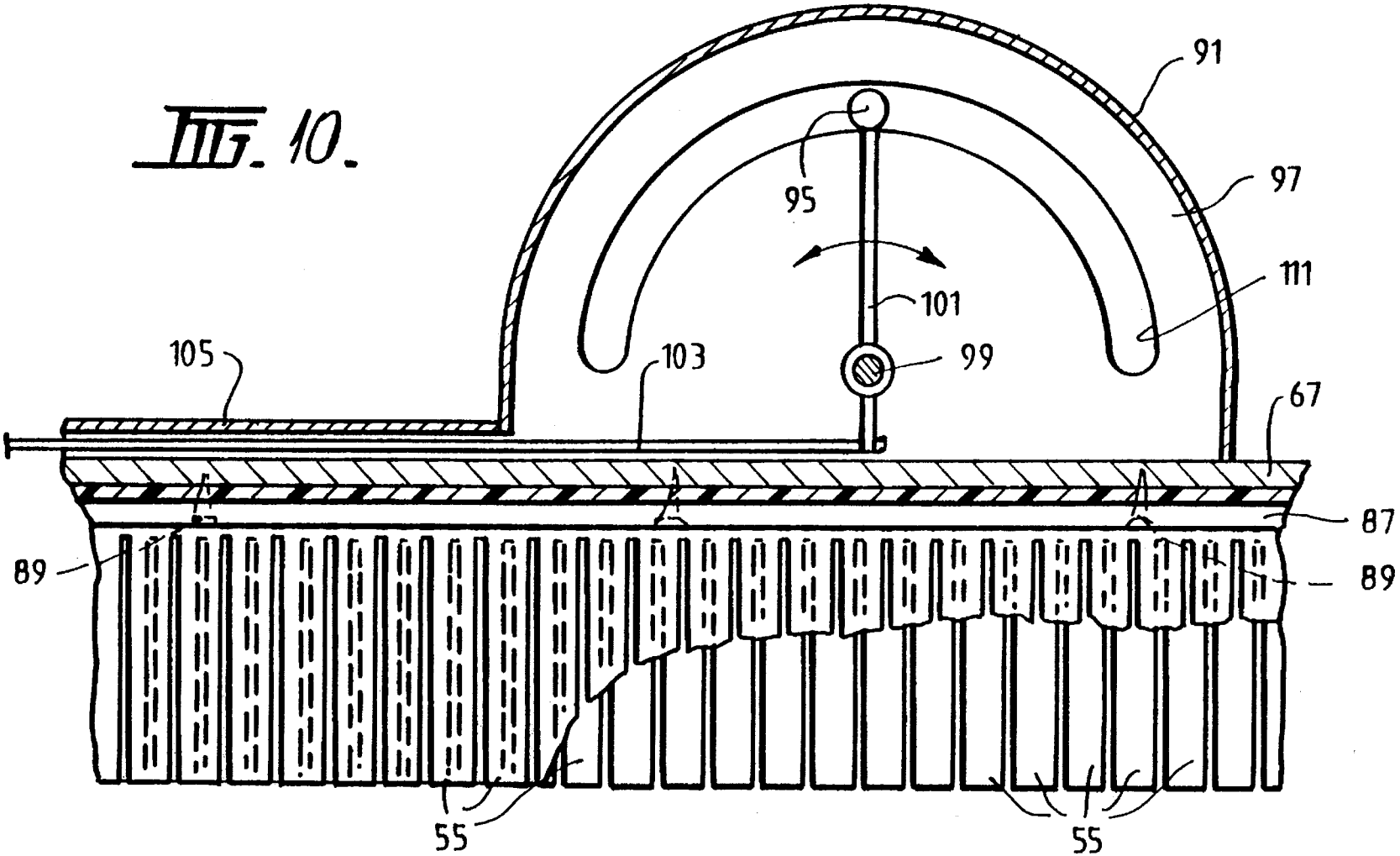
FIG. 10 is a sectional view taken along section line 10—10 of FIG. 9.
Figure 11:
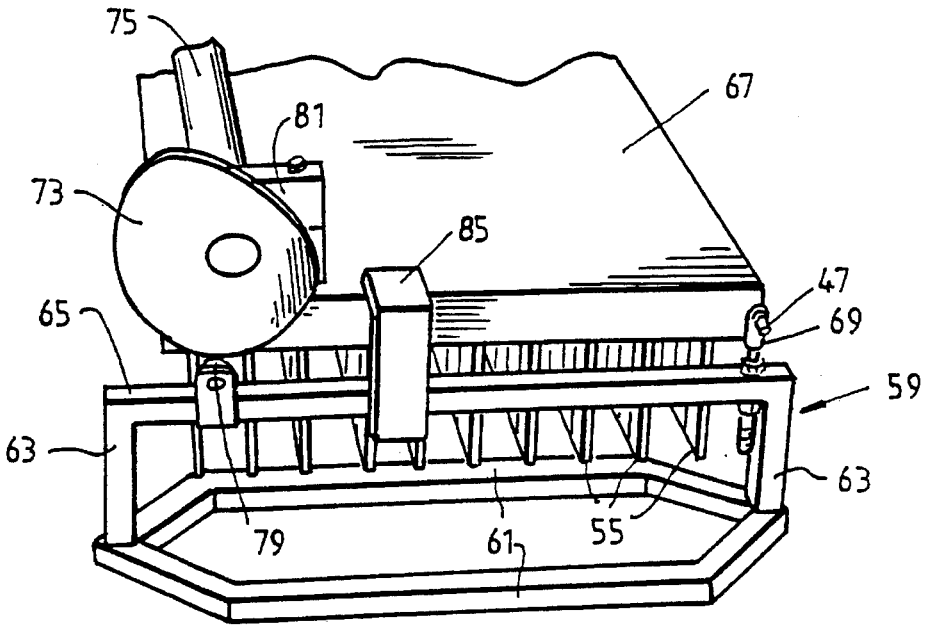
FIG. 11 is a top perspective view of one side of the device shown in FIGS. 7 through 10 showing detail of certain parts.
Figure 12:
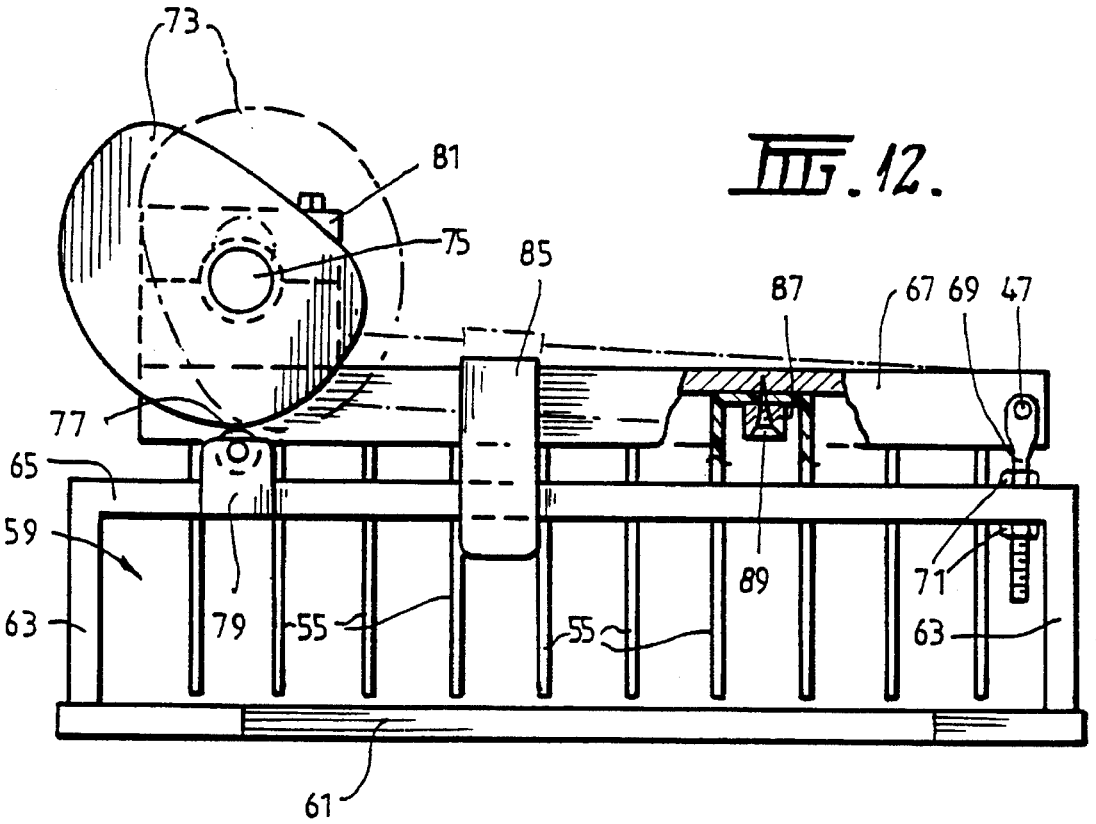
FIG. 12 is a side elevational view of the device taken from the same side as that shown in FIG. 11.

FIGS. 10 and 12 show the arrangement of how the depending members 55 can be fastened to the undersurface of the lid 67. Here a pair of rows of depending members 55 is comprised of one sheet of suitable material. The suitable material is bent in the middle as shown in FIG. 12 to form a substantially U-shaped transverse cross sectional member. A wooden slat 87 is provided under the strip of material and screws 89 fasten the slat to the undersurface of the lid 67 to, in turn, hold the depending members 55 from the undersurface of lid 67. Each of the rows of depending members 55 is preferably spaced equally as shown. FIG. 10 clearly shows how the depending members 55 in a first row are slit and offset by half the width of a depending member 55 relative to the next row. Thus, there is no alignment of slits between adjacent depending members in one row and the next.

Figure 7:
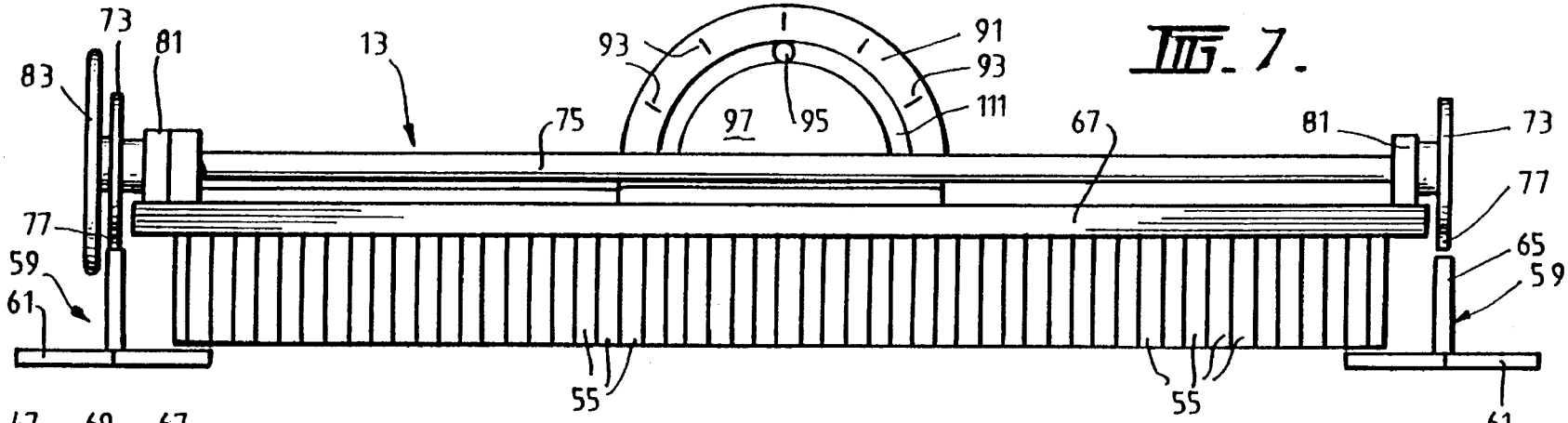
FIG. 7 is a front view of a further preferred device.
Figure 8:
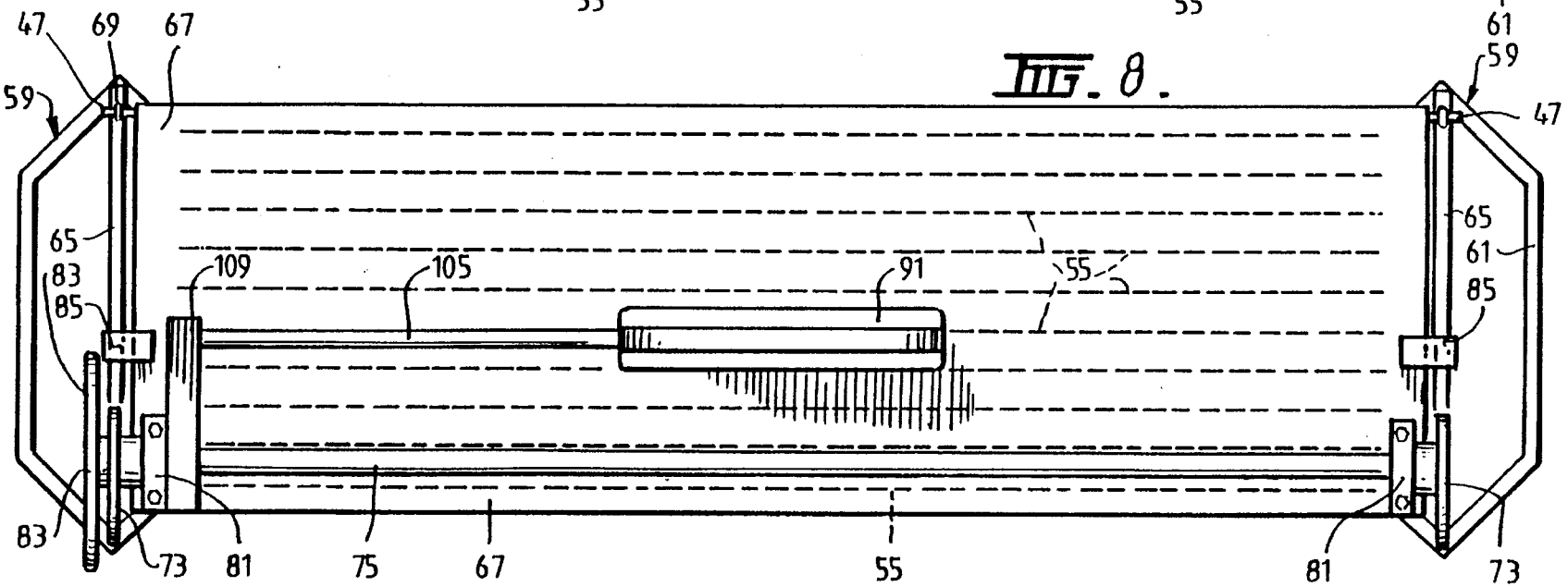
FIG. 8 is a plan view of the device shown in FIG. 7.
Figure 9:
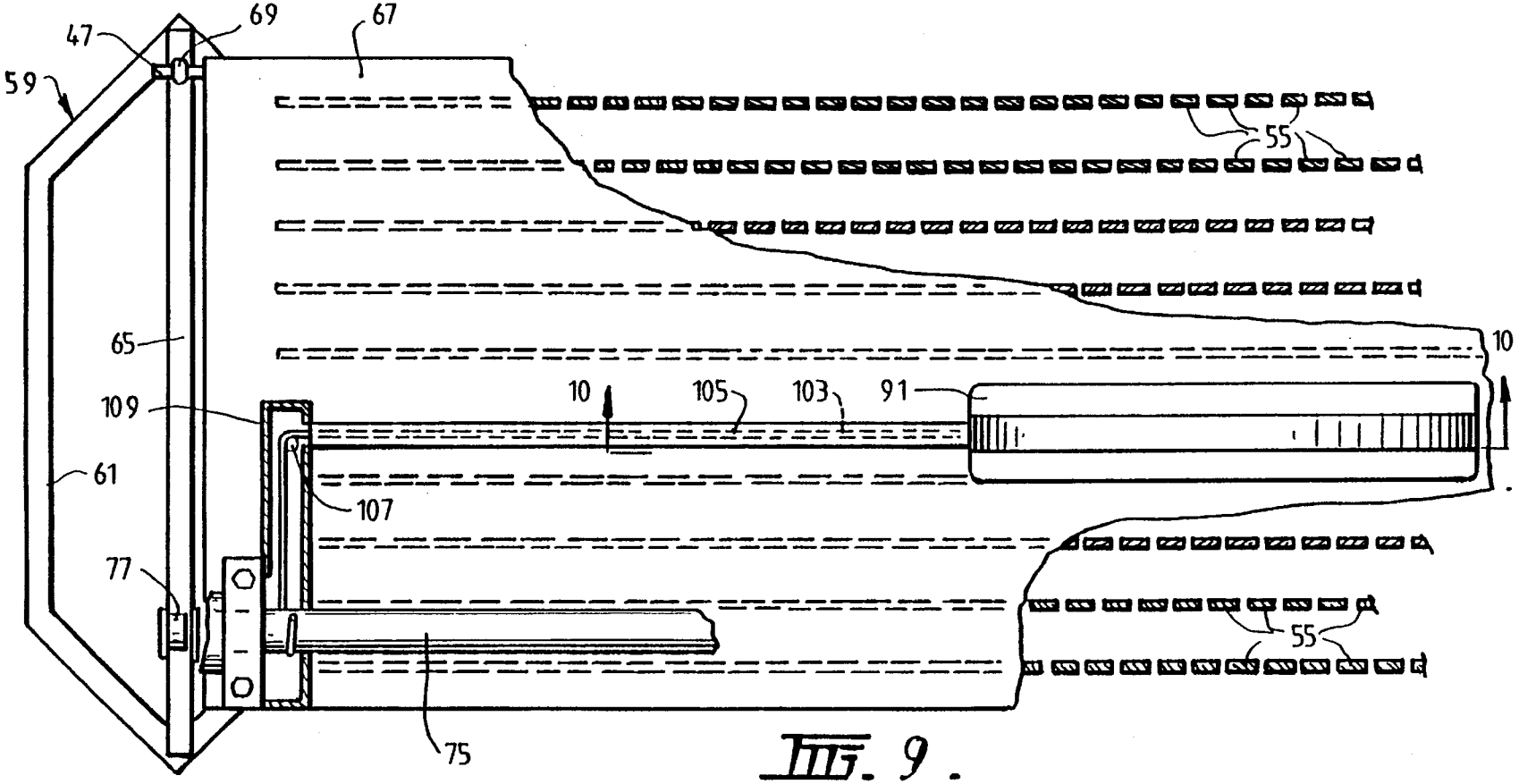
FIG. 9 is an enlarged part sectional view of the left hand side of the plan view shown in FIG. 8.

FIG. 7 shows an indicating means 91 with markings 93 thereon and a moving indicator 95 which can swing across the indicating means 91 to provide an indication of the length of rink which will be simulated by the degree of elevation of the lid 67 by the cams 73. The indicating means 91 comprises a half circular casing fabricated from sheet steel and held to the top of lid 45. The casing is therefore hollow. The casing has front and rear faces 97 and each face 97 has a hole therein through which an axle 99 passes. The axle 99 carries an arm 101 to which indicator 95 is attached at one end and to which at the other end is attached a chord 103. The chord passes through a conduit 105 attached to the top of lid 67 and around a post 107 to attach to the axle 75. Post 107 is mounted within a housing 109 at one side of the lid 67. A torsional spring (not shown) is mounted on axle 99 to apply a tension to the chord 103 at all times. Thus, when axle 75 is angularly rotated to raise lid 67 chord 105 is either wound onto or off axle 75 which, in turn, allows the arm 101 to swing so that indicator 95 can be viewed through an arcuate viewing aperture 111 in the casing 97. Thus, a person can look at the indicating means 91 and obtain an assessment of the length of rink being simulated by use of this device.

The threaded post 69 are provided to be adjustable in height so that by suitable height adjustment the pivot point for the hinge arms 47 can be raised or lowered. This will, in turn, raise and/or lower each of the depending members 55 at that end of the device. Such adjustment can be provided to simulate the conditions experienced on a conventional lawn bowling rink between wet (slow) or dry (fast) grass. Suitable markings may be provided on the threaded posts 69 to indicate wet or dry or any intermediate conditions.

Thus, in the embodiments of FIGS. 5 and 6, and FIGS. 7 through 12 the depending members 55 will flex as the bowl 5 passes the device 13 and because of the resilient nature of the material they will assume the position shown in the drawings following passing of the bowl 5. The depending members 55 may be made in any manner suitable such as by mouldling or attaching individual members 55 to the under-surface of the lid 67 and 45. It is considered that the embodiment shown in FIGS. 7 through 12 represents an economical embodiment. The depending members 55 are formed from sheets of solid vinyl of approximately 1.5–2.0 millimeters thickness. In each of the embodiments of FIGS. 5 and 6, and 7 through 12, there are twenty rows of depending members 55 even though a lesser number have been shown in the drawings. Each of the members 55 are approximately 200 millimeters in length and each slit is approximately 180 millimeters in length and approximately 5 millimeters in width. The depending members 55 extend to within about 5 to 20 millimeters from the surface 3.

It should be noted that in the embodiment shown in FIGS. 5 and 6, and 7 through 12, a bowl 5 can be passed through the device in either direction and the energy absorption will be the same in each case. Thus, with the devices shown in FIGS. 5 and 6, and 7 through 12, it is not necessary to rotate the device 13 through 180° when it is desired to play from the opposite end. Thus, in the case of devices 13 being fitted within a building 41 as depicted in FIG. 4, the devices 13 may be left substantially permanently fitted except for when they need to be completely removed when the building 41 is used for other purposes.

When the devices 13 are used for co-operating with bowling bowl as distinct from any rolling object to absorb kinetic energy therefrom, appropriate modification of the existing bowls rules may be required because of the accelerated time of play using the devices 13 and other factors consequent thereon. It may be found in practice that a new set of formal bowls may be developed using the device 13. It is contemplated however, that the basic rules of bowls be not substantially altered.

Modifications may be made to the examples shown above without departing from the ambit of the invention. As an example, the device 13 may be set-up so there is different kinetic energy absorption on one side of the device 13 relative to the other side, across the intended trajectory of the bowl 5. In this way the device 13 can be used to simulate different speeds of rink from one side of a rink to the other, as can be experienced on a conventional full length lawn green rink. Such modifications could be performed by persons skilled in the manufacturing arts of producing products of the nature outlined herein and such are deemed to be within the scope of the present invention. Accordingly, these and other modifications may be made without departing from the ambit of the invention the nature of which is to be determined from the foregoing description.

I claim:

1. A device for reducing the velocity of a passing rolling object, said device comprising:

a support frame for positioning the device on a support surface;

velocity reducing means; and frame means pivotally supported on said support frame, said velocity reducing means being attached to said frame means and positioned on a support surface relative to an intended trajectory of an object rolling on said support surface, said frame means comprising a front portion for entry of a rolling object and a rear portion for exit of a rolling object, said front and rear portions being spaced at a distance from one another, said velocity reducing means comprising co-operating means having first and last parts for engaging an upper surface of an object, said first part being positioned at the front portion of said frame means and said last part being positioned at the rear portion of said frame means, an upper end of said co-operating means being fixed to said frame means and a lower end of said co-operating means hanging downwardly from said frame means, said co-operating means being flexible for absorbing kinetic energy, whereby during passage of an object rolling past said device said co-operating means will deflect on engagement therewith to provide kinetic energy absorption therefrom to reduce velocity without substantially altering a trajectory of an object, said co-operating means further comprising a plurality of surface means extending substantially continuously across a width of said frame means between said first and last parts whereby substantially uniform velocity reduction will be achieved independent of a position at which a rolling object contacts said co-operating means across an intended direction of approach, said frame means being pivotable relative to said support frame whereby said front portion is raised or lowered relative to said rear portion to thereby reduce or increase absorption of said kinetic energy of a rolling object engaging said cooperating means.

2. A device as claimed in claim 1 wherein each of said plurality of surface means are strips.

3. A device as claimed in claim 1 wherein said plurality of depending members are held by said frame means in rows extending generally transversely to the trajectory of said object.

4. A device for use on a bowling rink comprising a planar surface on which a bowl is rolled and a device for altering an effective length of said bowling rink, said device comprising velocity reducing means and frame means supporting the velocity reducing means relative to an intended trajectory of said bowl, said velocity reducing means comprising co-operating means for co-operating with said bowl by engaging with an upper surface of said bowl, said co-operating means being flexible and hanging downwardly from said frame means, and having a first part of said co-operating means to contact said bowl and a last part of said co-operating means to contact said bowl, said first part and said last part being spaced along an intended continuous trajectory by a finite length before said bowl engages therewith, whereby during passage of said bowl rolling past said device said co-operating means will deflect on engagement with said bowl to provide kinetic energy absorption therefrom so the velocity of said bowl will be reduced without substantially altering the trajectory of said bowl, and indicator means for indicating the effective length of said bowling rink.

5. A device as claimed in claim 4 wherein said co-operating means is a plurality of depending members, said device further comprising pivoting means for pivoting said plurality of depending members relative to said frame means so as to, in turn, raise or lower said plurality of depending members, whereby said effective length is altered, and said indicator means includes means for detecting pivoting of said pivoting means and indicating a corresponding change in said effective length when said device is manually positioned on said rink.

* * * * *

UNITED STATES PATENT AND TRADEMARK OFFICE

CERTIFICATE OF CORRECTION

PATENT NO. : 5,529,542

DATED : June 25, 1996

INVENTOR(S) : MANSFIELD, Clifford

It is certified that error appears in the above—identified patent and that said Letters Patent is hereby corrected as shown below:

On the Title page,
Item [63] Continuation of Ser. No. 842,117, Mar. 24, 1992, abandoned, filed as PCT/AU90/00447, Sep. 25, 1990, published as WO91/04771, Apr. 18, 1991, abandoned.--

Signed and Sealed this

Fourteenth Day of January, 1997

Bruce Lehman

*Attest:*

BRUCE LEHMAN

*Attesting Officer*

*Commissioner of Patents and Trademarks*